US006238441B1

(12) United States Patent
Wallace et al.

(10) Patent No.: US 6,238,441 B1
(45) **Date of Patent: *May 29, 2001**

(54) HYDROPHILIC YARN DYED POLYESTER PROCESS

(75) Inventors: Jerry Wallace; Scott E. Tolley, both of Statesville; Marty Ervin, Charlotte; John E. Wilson, Belmont, all of NC (US)

(73) Assignee: Burlington Industries, Inc., Greensboro, NC (US)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/124,077

(22) Filed: Jul. 29, 1998

(51) Int. Cl.[7] ..... D06B 11/00
(52) U.S. Cl. ..... 8/494; 8/155; 8/550
(58) Field of Search ..... 8/494, 550, 155; 428/375, 395

(56) References Cited

U.S. PATENT DOCUMENTS

| | | | | |
|---|---|---|---|---|
| 3,618,609 | | 11/1971 | Glick . | |
| 3,773,463 | | 11/1973 | Cohen et al. . | |
| 3,821,136 | | 6/1974 | Hudgin et al. . | |
| 3,878,575 | | 4/1975 | Wedler . | |
| 3,960,341 | | 6/1976 | Thelen . | |
| 4,097,232 | * | 6/1978 | Negola et al. | 8/65 |
| 4,287,237 | | 9/1981 | Prudhomme et al. . | |
| 4,300,251 | | 11/1981 | Santens et al. . | |
| 4,442,249 | | 4/1984 | Lees et al. . | |
| 4,727,611 | | 3/1988 | Schwartzman . | |
| 4,874,019 | | 10/1989 | Whetstone . | |
| 4,925,726 | | 5/1990 | Whetstone . | |
| 5,172,443 | | 12/1992 | Christ . | |
| 5,240,660 | | 8/1993 | Marshall . | |
| 5,297,296 | | 3/1994 | Moretz et al. . | |
| 5,312,667 | * | 5/1994 | Lumb et al. | 428/91 |
| 5,387,263 | | 2/1995 | Marlowe et al. . | |

FOREIGN PATENT DOCUMENTS

| | | |
|---|---|---|
| 1034651 | of 1968 | (GB) . |
| 72-023718 | of 1972 | (JP) . |
| 48-067882 | of 1974 | (JP) . |
| 48-096828 | of 1974 | (JP) . |
| 51-026397 | of 1976 | (JP) . |
| 59-106517 | of 1984 | (JP) . |
| 9-291429 | of 1997 | (JP) . |
| 9411322 | of 1996 | (KR) . |

* cited by examiner

*Primary Examiner*—Blaine Copenheaver
(74) *Attorney, Agent, or Firm*—Nixon & Vanderhye

(57) ABSTRACT

A process for preparing moisture wicking polyester fabrics is disclosed which comprises the steps of: winding hydrophobic polyester yarn onto a package; subjecting the wound package to a dyebath including at least one dye and an agent rendering the polyester yarn hydrophilic while subjecting the yarn to elevated temperatures, pressures or both to dye the polyester yarn and render the polyester fibers hydrophilic; and preparing the thus dyed and treated polyester yarn into a fabric, biaxially stretching and heat-setting the fabric.

4 Claims, No Drawings

HYDROPHILIC YARN DYED POLYESTER PROCESS

BACKGROUND OF THE INVENTION

This invention relates to a process for preparing polyester yarn capable of wicking away moisture from the body and making the wearer more comfortable by treating polyester fibers in the form of yarn to make the normally hydrophobic polyester fibers hydrophilic.

Traditionally piece dyed goods have been processed and treated in fabric form with finishes to render the polyester hydrophilic and this limits the styling possibilities to solid shades.

Various proposals have been made to impart hydrophilic properties to synthetic fibers, particularly nylon and polyester, in the piece goods or fabric form. For example, fleece type sweatshirt fabrics in the form of a composite textile fabric having a first layer of a polyester or nylon material rendered hydrophilic and a second layer or a moisture absorbent material such as nylon are disclosed in U.S. Pat. No. 5,312,667 to Lumb et al. After knitting the fabric, the nylon or polyester component of the two layer fabric is rendered hydrophilic by treating the fabric in a dye bath to which a low molecular weight polyester such as Milease T (I.C.I.), Scotchguard FC-226 (3-M) or Zelcon (DuPont) has been added. The nylon- or polyester-containing layer of the composite is treated and dyed in fabric form.

Colored polyester fibers having hydrophilic groups grafted onto them are described in JP-A (Kokai) 48-96828 (1973). Colored graft fibers, prepared from solution (pigment) dyed polyester fibers placed in a dyeing machine with a hydrophobic radical initiator, organic solvent and hydrophilic monomer to graft polymerize the hydrophilic monomer onto the surface of the polyester fibers. The resultant product is said to have antistatic, moisture absorption, water absorption, soil resistance and thermal stability properties. This procedure requires the use of organic solvents insoluble in water, initiators and monitors, etc. all maintained under graft polymerization temperature and pressure conditions to fundamentally alter the characteristics of the polyester fibers, conditions not particularly convenient to conventional polyester yarn dyeing and processing.

It would be advantageous to include within the usual polyester dyeing process a treatment to render the normally hydrophobic polyester fibers hydrophilic and, in particular, to include this treatment in an otherwise conventional package dyeing operation. The resulting yarns may be knitted into either solids or styles such as jacquards, scoured and heatset without reducing the hydrophilic properties imparted concurrently during the dyeing operation.

DETAILED DESCRIPTION OF THE INVENTION

The present invention provides finishing procedures capable of rendering normally hydrophobic polyester fibers hydrophilic while the fibers are in yarn form, conveniently concurrently with the yarn dyeing process, to produce suitably treated and colored yarns which are then knitted in solid or multicolored jacquards, scoured, heatset and constructed into garments or the like. Hydrophilic treatment is easily incorporated into the package yarn dyeing operation by including the additional finish or finishes and agents into the dyebath into existing processing without changes or substantial changes in equipment and operating personnel.

According to the invention, the yarn may be dyed in the form of a package in which the yarn is placed on a "package" such as a skein, cone, beam or spool. The package is sealed in a dyeing machine and subjected to elevated pressures and/or temperatures to force the dyebath, which includes the hydrophilic chemical, to pass back and forth through tightly wrapped yarns to accomplish the desired treatment, in this case both dyeing and rendering the normally hydrophobic fibers of the polyester yarns hydrophilic. U.S. Pat. No. 3,878,575 to Wedler and U.S. Pat. No. 4,097,232 to Negola et al are illustrative of the equipment and procedures for dyeing and treating packages of polyester yarn. Subsequent to package dyeing and hydrophilic finishing, the yarn may be knit into a tube, or other configuration, optionally scoured with a soap or detergent, then biaxially stretched such as in a tenter frame or oven and heatset all using conventional fluids, equipment and procedures.

The process is suited to a wide variety of polyester yarns suited to the practical weight of the product to be produced. They may be spun yarns such as prepared by ring, OE or air jet spinning or filament yarns. The agent providing the desired hydrophilic properties to the polyester yarn is selected from a variety of commercially available materials including Hydrolon (Consolidated Chemical) and Scotchguard FC-226 (3M)

EXAMPLE

Polyester yarn (18/1 ring spun) wound onto a package was dyed with a disperse dye including a hydrophilic agent in the dye bath. The yarn was loaded into the dye kier and the kier filled with water and heated to 160° F. For dyeing to light shades a dyebath was prepared containing the following components (in percent by weight):

| disperse dye(s) | depending upon color |
|---|---|
| acetic acid (20%) | 1.2% |
| leveling agent | 2.0% |
| hydrophilic agent (Scotchguard FC-226) | 1.5% |
| magnesium chloride | 2.0% |

The dyebath was circulated at 160° F. for 5 minutes, heated to 200° F. at 3 F/minute, then heated to 265° F. at 2 F/minute and circulated at 265° F. for 20 minutes. Next the bath was drained, the unit overflowed with water at 90° F. for 10 minutes then the water was drained. The unit was then filled with water at 160° F. and circulated for 10 minutes then overflowed with water at 90° F. for 5 minutes, then the water was drained.

For medium to dark shades a reduction clearing step is added to include, after the above steps, filling the kier with water and heating to 160° F., adding a mixture of 2% soda ash and Pres Clear Wrm 2%, heating to 180° F. at maximum heating rate and circulated for 15 minutes then drained, filled with water and heated to 160° F. at maximum heating rate and circulate for 10 minutes, then overflowed with water at 90° F. for 5 minutes. The yarn was then dried and wound for knitting into the desired construction.

The knit fabric was next finished as a knit tube in a batch process first scoured in a beck using soap (Sedgescour LCP, 2 grams/liter) and a defoamer (Hipochem NSD, ¼ gram/liter), then heated to 140° F. and circulated for 30 minutes, overflowed with water at 120° F. for 20 minutes then drained The beck was again filled with water then the fabric was unloaded and slit to open the fabric. Final processing and setting was conducted on a tenter frame where the slit fabric was padded with water (only), biaxially stretched and heat set at 350° F.

Shrinkage was under 7% in the length and width after three standard washings and dryings. Water absorbency was tested by dropping plain water on the fabric; water so applied must be absorbed within 3 seconds to be acceptable for this particular test. The fabric should retain this characteristic for up to 50 washings and dryings to assure durability of the hydrophilic agent on the polyester.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A process for preparing moisture wicking polyester fabrics comprising the successive steps of:

(a) winding hydrophobic polyester yarn onto a package;

(b) subjecting the wound package to a dyebath including at least one dye and an agent rendering the polyester yarn hydrophilic while subjecting the yarn to elevated temperatures, pressures or both to dye the polyester yarn and render the polyester fibers hydrophilic; and (c) preparing the thus dyed and treated polyester yarn into a fabric, biaxially stretching and heatsetting the fabric to provide a fabric constructed entirely of the moisture wicking polyester yarn that retains its hydrophilic properties after multiple washings.

2. The process according to claim 1 in which the polyester yarn is a filament yarn.

3. The process of claim 1 in which the polyester yarn is a spun yarn.

4. The process of claim 1 in which the dyed, treated polyester yarn is knit into a fabric in step (c).

* * * * *